US005146207A

United States Patent [19]

Henry et al.

[11] Patent Number: 5,146,207

[45] Date of Patent: Sep. 8, 1992

[54] SECURE FIELD MONITORING DEVICE FOR USE IN ELECTRONIC HOUSE ARREST MONITORING SYSTEM

[75] Inventors: Daniel L. Henry, Boulder; Gregory A. Muir, Lyons; Joseph P. Desimone, Boulder, all of Colo.

[73] Assignee: BI, Incorporated, Boulder, Colo.

[21] Appl. No.: 723,481

[22] Filed: Jul. 1, 1991

[51] Int. Cl.[5] ..... G08B 21/00

[52] U.S. Cl. ..... 340/573; 340/572; 340/875.54; 379/38

[58] Field of Search ..... 340/573, 572, 825.54; 379/38

[56] References Cited

U.S. PATENT DOCUMENTS

| | | | |
|---|---|---|---|
| 4,528,623 | 7/1985 | Tachibana | 364/191 |
| 4,542,452 | 9/1985 | Fukai et al. | 364/141 |
| 4,600,918 | 7/1986 | Belisomi et al. | 340/711 |
| 4,691,340 | 9/1987 | Maeda et al. | 379/96 |
| 4,747,120 | 5/1988 | Foley | 379/38 |
| 4,777,477 | 10/1988 | Watson | 340/573 |
| 4,831,226 | 5/1989 | Robeson et al. | 219/10.55 B |
| 4,918,432 | 4/1990 | Pauley et al. | 340/573 |
| 4,952,928 | 8/1990 | Carroll et al. | 340/825.54 |
| 4,965,557 | 10/1990 | Schepers et al. | 340/711 |

*Primary Examiner*—Glen R. Swann, III
*Attorney, Agent, or Firm*—Fitch, Even, Tabin & Flannery

[57] ABSTRACT

A field monitoring device (FMD) for use in an electronic house arrest monitoring (EHAM) system has an infrared (IR) communications port concealed in the back of its housing. A strain relief fixture for the power cord covers the IR port during normal FMD operation. This strain relief fixture is removable only with a special tool. The IR port includes two small holes. Inside one hole is an infrared receiver. Inside the other hole is an infrared transmitter. Data communications with the FMD is established by optically linking a matching infrared receiver included in a coupling head of an IR adapter with the infrared transmitter within the FMD; and by similarly optically linking a matching infrared transmitter with the infrared receiver within the FMD. The IR adapter interfaces with a conventional data terminal, such as a personal computer, which data terminal functions as an external programmer for the FMD. Only those who have possession of the external programmer, and who have the special tool and knowledge of the location of the infrared communications port, are able to establish a communications link with the FMD. Once the communications link is established, access to the memory and other circuits of the FMD is not provided until certain other prescribed steps are taken, including the proper placement of a key switch incorporated on the FMD housing, and the proper timed insertion of access codes and passwords through the external programmer.

20 Claims, 9 Drawing Sheets

SECURE FIELD MONITORING DEVICE FOR USE IN ELECTRONIC HOUSE ARREST MONITORING SYSTEM

BACKGROUND OF THE INVENTION

The present invention relates to an electronic house arrest monitoring (EHAM) system, and more particularly to a particular type of field monitoring device (FMD) used in such an EHAM system that cannot be altered or reprogrammed except by authorized personnel.

An EHAM system is a particular type of electronic monitoring system that electronically monitors a predefined area for the presence of a particular individual. Typically, the predefined area is the residence and/or work place of the individual. The individual being monitored is usually a person who has been convicted of a crime and sentenced to a specific term of incarceration, or is on probation. Sometimes the person being monitored has already served a sentence and is on parole, but must report in at regular intervals to a parole officer. Because the monitored individual has normally been convicted of some type of offense, such monitored individual is hereinafter referred to as an "offender".

Advantageously, EHAM systems allow many incarcerated offenders to serve part or all of their sentence outside of a normal detention facility. Thus, rather than serving their sentence in an overcrowded jail or prison, the offender is simply sentenced to remain at a specified location, such as his or her house, under "house arrest". The EHAM system advantageously monitors the specified location to assure compliance with the house arrest order, and immediately reports any detected violations of the house arrest order to the appropriate officials.

Moreover, EHAM systems allow probation officers, and others charged with the responsibility of assuring compliance with a particular sentence, probation or parole requirement, to more easily monitor a relatively large group of offenders for compliance with their respective house arrest requirements.

Electronic monitoring systems thus fulfill a valuable need in that they allow a relatively large number of individuals, who have been ordered by a court to remain under house arrest, or who are under specific parole or probation requirements, to be electronically monitored for compliance with whatever restrictions have been imposed. Such electronic monitoring can advantageously be carried out at a fraction of the cost of incarceration of the monitored individuals, and also at a much reduced cost compared to conventional probation/parole monitoring procedures.

One type of EHAM system known in the art, referred to as an "active" monitoring system, generates and transmits radio wave signals as part of the monitoring process. Such an active EHAM system is described, e.g., in U.S. Pat. No. 4,918,432, issued to Pauley et al., which patent is incorporated herein by reference. In the Pauley et al. EHAM system, each offender being monitored is fitted with an electronic bracelet or anklet. Such bracelet or anklet, referred to in the referenced patent as a "tag", includes a transmitter that periodically transmits an identifying radio wave signal (unique to each tag, and hence to each offender) over a short range (e.g., 150 feet). A field monitoring device (FMD) is installed at each where the monitored offender(s) is supposed to be. If the monitored offender(s) is present at the FMD location, a receiver circuit within the FMD receives the unique identifying signal. Processing circuits within the FMD determine if the received identifying signal is a valid signal assigned to a particular offender. The FMD processing circuits can thus determine whether a specific offender is present at the location of the FMD when the signal is received. This information is stored within the FMD memory circuits for subsequent downloading to a central monitoring location.

A computer, or central processing unit (CPU), located at the central monitoring location (which location is typically remote from the FMD location), periodically or randomly polls the various FMD locations through an established telecommunicative link, e.g., through standard telephone lines, in order to prepare reports indicating the presence or absence of the offenders at the specified locations. Such reports are then used by the agency charged with the responsibility for monitoring the offenders to ascertain whether or not such monitored offenders are in compliance with whatever restrictions have been imposed.

An important feature of the Pauley et al. EHAM system is the ability of the tag to detect any attempts to tamper with it, e.g., attempts to remove the tag from the monitored offender. If a tamper event is detected, such occurrence is signaled to the FMD in the next identifying signal that is transmitted; and the FMD, in turn, includes the ability to establish telecommunicative contact with the central CPU in order to report such tamper event. All data sent from the FMD to the central CPU includes address-identifying data that identifies the specific location where the FMD is located.

Other active EHAM systems known in the art also include the ability to detect tamper events, such as U.S. Pat. No. 4,777,477, issued to Watson, wherein any attempt to cut or break the strap that attaches the tag to the individual is detected and signaled to a local receiver.

Still additional active EHAM systems known in the art include the ability to adaptively change the monitoring configuration to best suit the needs of the agency responsible for carrying out the monitoring function. See U.S. Pat. No. 4,952,928 issued to Carroll et al., also incorporated herein by reference. The Carroll et al. system advantageously includes the ability to sense and monitor various physiological data of the monitored individual, such as heart rate, blood pressure, body position (horizontal or vertical), and the like, so that such data can be analyzed at the central monitoring location to determine if the monitored individual is complying with other restrictions, such as abstinence from drugs or alcohol.

Another type of EHAM system known in the art, typically referred to as an "passive" monitoring system, requires the offender being monitored to perform some act, such as inserting a specially configured, non-removable, wristlet into a decoder device, in order to verify his or her presence at the remote monitoring location. The decoder device, which may be considered as the equivalent of the FMD, then telecommunicatively communicates with a CPU at a central monitoring location in order to report that the presence of the offender was successfully detected. See, e.g., U.S. Pat. No. 4,747,120.

Regardless of the type of EHAM system used —passive or active—there is a need for a given level of environmental security associated with the installation and use of an FMD or equivalent device. The FMD includes certain electronic processing circuitry, typically realized using at least one microprocessor circuit coupled to appropriate memory circuits, that controls the monitoring function. The FMD also includes, in its memory circuits, programmable operational parameters that are critical to the monitoring process. Although it is necessary to provide a means of communicating with the FMD to inspect and/or change its operational parameters, it is imperative that access to these operational parameters, and to the memory circuits in general, be secure and accessible only to authorized individuals. At no time should the monitored offender be allowed access to the FMD memory circuits.

Unfortunately, with a remote unmanned monitoring system such as an EHAM system, there is always the risk that the offender may try to thwart the system. That is, the offender may try to disable or modify the functions of the FMD through any means possible. Such approaches may include, but are not limited to, introducing dangerous voltages to exposed connector contacts, shorting exposed contacts with metallic objects, disconnecting power and telephone lines, etc. What is needed, therefore, is an FMD that is tamper proof, and that is immune to all such attempts to thwart its proper operation.

Moreover, it is not uncommon for a particular offender to have a working knowledge of personal computers, and/or popularly used data communication systems and protocols. Such an offender may thus be tempted to tamper with the FMD, and more particularly to interfere with the transfer of data between the FMD and CPU at the central monitoring location, and/or to "reprogram" the FMD so that it operates incorrectly, thereby causing the FMD to provide false information to the central monitoring location. If the FMD employs conventional data communication schemes and protocols, the ease with which such tampering could be accomplished is significantly enhanced. Thus, there is a need in the art for a more secure data transfer link between the FMD and the CPU, as well as a more secure method of accessing and programming an FMD. In particular, there is a need for a secure FMD programming technique or method that cannot be ascertained through a physical inspection of the FMD, and that is accessible and usable only by authorized personnel.

Further, even for individuals who are authorized to gain access to the FMD's operational parameters, not all such authorized individuals need access privileges to the same set of operational parameters. Thus, for example, an installer who installs an FMD in the field may only need access to a limited subset of operational parameters. An authorized factory representative, on the other hand, may need access to all operational parameters. Hence, there is a need in the art not only to limit access to the FMD's operational parameters to authorized personnel, but also to provide different levels of access to different types of authorized personnel.

SUMMARY OF THE INVENTION

The present invention advantageously provides a field monitoring device (FMD) for use in an electronic house arrest monitoring (EHAM) system that addresses the above and other needs. In accordance with one aspect of the invention, an FMD is provided that is housed within a rugged, yet attractive, closed housing. Concealed in the back of the FMD housing, however, behind a strain relief fixture for the power cord, are two small holes. These holes are not visible unless the strain relief fixture is removed, which removal requires the use of a special tool. Inside one of these holes is an infrared receiver. Inside the other hole is an infrared transmitter. A data communications channel or link with the FMD is thus established by positioning a matching infrared receiver so that it is optically coupled with the infrared transmitter inside of the FMD, and by positioning a matching infrared transmitter so that it is optically coupled with the infrared receiver inside of the FMD.

In accordance with another aspect of the invention, an external programmer has a coupling head containing an infrared transmitter and receiver that are spatially positioned to be complementary to those of the FMD. A communication link is thus established by removing the strain relief fixture from the FMD using the special tool, and aligning the coupling head of the external programmer with the exposed holes in the FMD. Such alignment is effected automatically by replacing the strain relief fixture with the coupling head. Thus, only those who have possession of the external programmer, and who have the special tool and knowledge of the location of the infrared communications port, can establish a communications link with the FMD. Advantageously, such communication link does not require standard metallic electrical circuit contact between the FMD and external programmer, which direct metallic circuit contact might provide a circuit path for electrostatic or other electrical discharge into either device.

Another aspect of the invention allows an external monitoring or peripheral device to be used with the FMD. Such peripheral device may be, for example, a voice analyzer, alcohol detector, or like device used to detect a particular individual or the state of a particular individual. Advantageously, such peripheral device may be securely coupled to the FMD through the infrared communications port concealed behind the strain relief fixture on the back of the FMD. When such external devices are used, a coupling head, similar to the one used with the external programmer, replaces the strain relief fixture, and connects directly with the external monitoring device.

In accordance with a further aspect of the invention, even though a communications link is physically established with the FMD, access to the memory and other circuits of the FMD through the communications link is restricted to authorized personnel. That is, in order to examine or alter the operating parameters of the FMD, certain other prescribed steps, in addition to phsically establishing the IR communications link, must be taken, which prescribed steps are known only to authorized personnel. These steps include the proper placement of a key switch incorporated on the FMD housing, and the proper timed insertion of access codes and passwords through the external programmer. Advantageously, only when the key switch is placed in the correct position (which placement requires the key to the key switch), and only when the proper access codes are inserted in a prescribed sequence at specific time intervals relative to a self test sequence performed by the FMD when power is first applied, and only when a password is entered and validated, is access to the operating parameters of the FMD through the communications link granted. Thus, in this manner the operation and programming of the FMD is secure because only authorized personnel, i.e., personnel having knowledge of the location of the infrared communications port, personnel having an external programmer, personnel having a key to the key switch and knowledge of its correct position, and personnel knowing the access codes, passwords and timed sequence in which such must be entered, are granted access to the FMD for the purpose of examining or altering its operating parameters.

In accordance with still another aspect of the invention, the expeditious manufacture of the FMD is facilitated by providing configuration jumpers on the internal circuit boards. Advantageously, during the manufacture of the FMD, when the FMD housing is open and the internal circuit boards are exposed or not yet installed within the housing, a configuration jumper is inserted in a designated location. This configuration jumper allows the time consuming authorization validation techniques described herein to be avoided altogether. When factory testing and programming has been completed, and before the FMD housing is closed, the manufacturing jumpers are removed. The FMD housing is then closed, and once closed, the validation techniques described herein must thereafter be used in order to examine or alter the FMD's operating parameters. Advantageously, it is not possible to reopen the FMD housing once closed without evidence of tampering.

The present invention may thus be characterized as a monitoring apparatus usable with an electronic house arrest monitoring (EHAM) system for monitoring the presence or absence of a specified individual at an assigned location remote from a central monitoring location. Such monitoring apparatus includes: (1) a closed housing; (2) detection means within the housing for detecting the presence or absence of the specified individual at the assigned location; (3) control means within the housing for controlling the operation of the monitoring apparatus in accordance with a set of preprogrammed operating parameters; (4) electrically erasable programmable read only memory (EEPROM) means within the housing for storing the operating parameters; (5) erasable programmable read only memory (EPROM) means within the housing for storing the FMT program; (6) random access memory (RAM) means within the housing for storing data processed by the control means; (7) first port means for allowing data access into and out of the RAM means through the control means from a location external to the housing, thereby allowing data to be selectively transferred between the random access memory means and an external device, such as a computer at the central monitoring location; (8) second port means coupled to the control means for selectively allowing data to be loaded into the EEPROM means from an external programming device, and for selectively allowing data stored in the EEPROM means to be read by the external programming device, this second port means being concealed on said housing; and (9) access means for allowing access to the EEPROM means through the second port means only when a plurality of prescribed conditions has been met. Advantageously, the operating parameters for the control means of such monitoring apparatus can thus be accessed only by personnel having knowledge of the location of the second port means and the plurality of prescribed conditions.

The invention may also be viewed as a method for restricting access to the operating parameters of a field monitoring device (FMD) used with an electronic house arrest monitoring (EHAM) system. The FMD with which this method is used includes a microprocessor that controls the operation of the FMD as controlled by the operating parameters. The FMD further includes an electrically erasable programmable read only memory (EEPROM) device wherein the operating parameters are stored.

A first step of this restricted access method includes concealing a data communications port on a housing of the FMD. Advantageously, this concealed data communications port is visible only upon the removal of a protective plate. Further, the protective plate is disguised so as not to appear as a protective plate or cover, but rather appears as a strain relief fixture for the power cord of the FMD. Moreover, the protective plate is removable only through the use of a specially configured tool.

A second step of the restricted access method involves removing the protective plate using the specially configured tool.

A third step includes detachably securing to the data communications port a coupling head that is coupled to an external programming device. This coupling head requires the use of the specially configured tool in order to secure it to the data communications port. The external programming device has readily accessible keyboard means for manually keying in data into the FMD through the data comaunications port, and display means for displaying data stored in the EEPROM device.

Finally, a fourth step of the restricted access method includes inhibiting or preventing data access through the data communications port until such time as a plurality of prescribed conditions have been established. These prescribed conditions include the proper setting of a key switch, and the entry of one or more predefined passwords or access codes at the correct time after power has been applied to the FMD.

Advantageously, through use of this restricted access method, only personnel having knowledge of the existence and location of the data communications port, and having the specially configured tool and the external programming device, and further having knowledge of the plurality of prescribed conditions, are able to gain access to the operating parameters stored in the EEPROM device for the purpose of examining or reprogramming these operating parameters.

It is thus a feature of the present invention to provide an FMD for use in an EHAM system that is "secure", i.e., that is substantially tamper proof, and that is immune to attempts to thwart its proper operation.

It is an additional feature of the invention to provide such a secure FMD that utilizes a more secure method of accessing and programming the FMD. In particular, it is a feature of the present invention to provide a secure FMD that uses a nonstandard communication link between it and an external programmer, one that does not have any exposed connectors or other visible communication ports through which an offender might be tempted to interfere or tamper with the operation of the FMD.

It is another feature of the invention to provide a secure FMD wherein different levels of access to the FMD's operational parameters are provided to different types of authorized personnel, i.e., programmable access to a full set or a subset of the programmable FMD operational parameters is a function of the authorized personnel's particular authorization level. It is a related feature of the invention to provide an FMD wherein the FMD does not exhibit any behavior other than what would be considered normal operation when there is a failed attempt to gain access. Hence, unauthorized individuals (who have no knowledge of the access mechanisms) are not "clued in" to the fact that any such access means exists.

It is yet a further feature of the invention to provide an FMD for use with an EHAM system wherein factory testing and programming of the FMD is facilitated, thereby expediting the manufacturing process.

It is still another feature of the invention to provide a secure nonstandard communication interface with an FMD used in an EHAM system so that options external to the FMD may be coupled to the FMD through such nonstandard communications link. Such options may include, for example, voice verification circuits, alcohol detection devices, signature analysis apparatus, and the like.

BRIEF DESCRIPTION OF THE DRAWINGS

The above and other aspects, features and advantages of the present invention will be more apparent from the following more particular description thereof, presented in conjunction with the following drawings wherein.

In all of the above figures, corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

Figure 1:
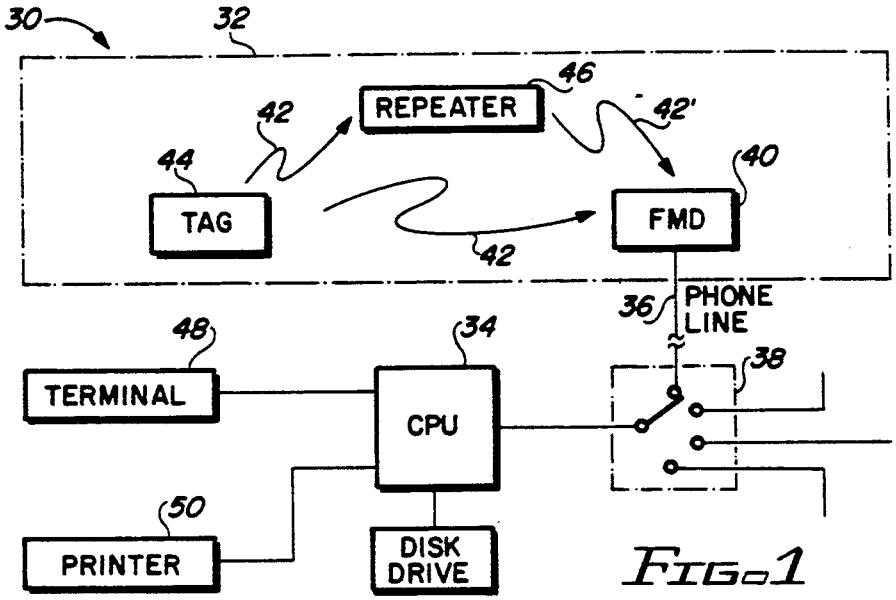
FIG. 1 is a block diagram of an electronic house arrest monitoring (EHAM) system, and shows how a field monitoring device (FMD) is used within such system.

In order to better appreciate the environment wherein the present invention is used, reference is first made to FIG. 1 where there is shown a block diagram of an active electronic house arrest monitoring (EHAM) system 30. It should be noted that while an active EHAM system will be described herein as representative of EHAM systems with which the present invention may be used, the present invention, which is directed to a field monitoring device (FMD) used within an EHAM system, also has applicability to other types of EHAM systems, such as a passive EHAM system.

Referring then to FIG. 1, the active EHAM system 30 includes a plurality of remote monitoring areas 32 and a central processing unit (CPU) 34. The CPU 34 is coupled to the remote monitoring area 32 by way of a residential telephone line 36. One or more conventional switching stations 38 couple the phone line 36 to the CPU 34. Such switching stations 38 are conventional switching stations commonly employed by the telephone company. As will be appreciated by those skilled in the art, other types of telecommunicative contact could also be used to connect the CPU 34 to the remote monitoring area 32.

Within each remote area 32 there is included a field monitoring device (FMD) 40. The FMD 40 receives periodic signals 42 from an identification tag 44. These identification (ID) signals 42 contain information that uniquely identifies the tag 44 from which the signal originates. The ID signals 42 may also indicate, in some embodiments, the status of the circuits internal to the tag, and especially whether such circuits have sensed an attempt to remove or otherwise tamper with the tag.

Depending upon the particular characteristics of the remote monitoring area 32, the system may also include a repeater 46 that can be selectively positioned within the area 32. The purpose of the repeater 46 is to receive the ID signals 42 from the tag 44 and retransmit these signals, after a short delay, to the FMD 40 to eliminate dead spots. Such retransmitted signals are identified in FIG. 1 as signals 42'.

While only one tag 44 is shown in FIG. 1, it is understood that most EHAM systems can function with a plurality of tags 44 within the monitoring area 32, all of which are monitored by the same FMD 40. In such instance, each tag generates its own unique ID signal at periodic intervals.

The CPU 34 is coupled through the telephone switching network 38, or through an equivalent telecommunicative link, to a large number of remote monitoring areas, each of which has its own FMD. The CPU 34 typically polls the FMDs at each of the remote monitoring areas, either randomly or in a prescribed sequence, in order to receive data that indicates the presence or absence of specific tags (and hence specific offenders to whom the specific tag has been assigned) at each of the remote locations.

In addition, should the ID signal 42 received from a given tag 44 indicate that a tamper condition has been detected, or should tamper circuits within the FMD 40 be tripped, also indicating a tamper condition within the FMD, the FMD 40 is programmed to initiate a telephone call to the CPU 34, or to otherwise establish a telecommunicative link with the CPU 34, so that such tamper condition may be reported to the CPU as soon as possible.

Coupled to the CPU 34 is at least one terminal 48 that provides a means for the CPU 34 to display the status of the various remote monitoring areas to which it is coupled, as well as to provide an operator the means for entering data or instructions into the CPU. Such terminals 48 are common in the art, typically including a CRT or LCD display screen and keyboard. Also coupled to the CPU 34 is a printer 50 that can be used to print status reports and other information concerning the operation of the EHAM system 30.

The operation and construction of the elements of the EHAM system 30 shown in FIG. 1 may be as is known in the art. The present invention is directed to particular improvements that are included in the FMD 40, and more particularly to improvements that make the operation and use of the FMD 40 more secure, i.e., less susceptible to attempts to interfere with its operation through the unauthorized altering of the operating parameters stored within the FMD.

Figure 11:
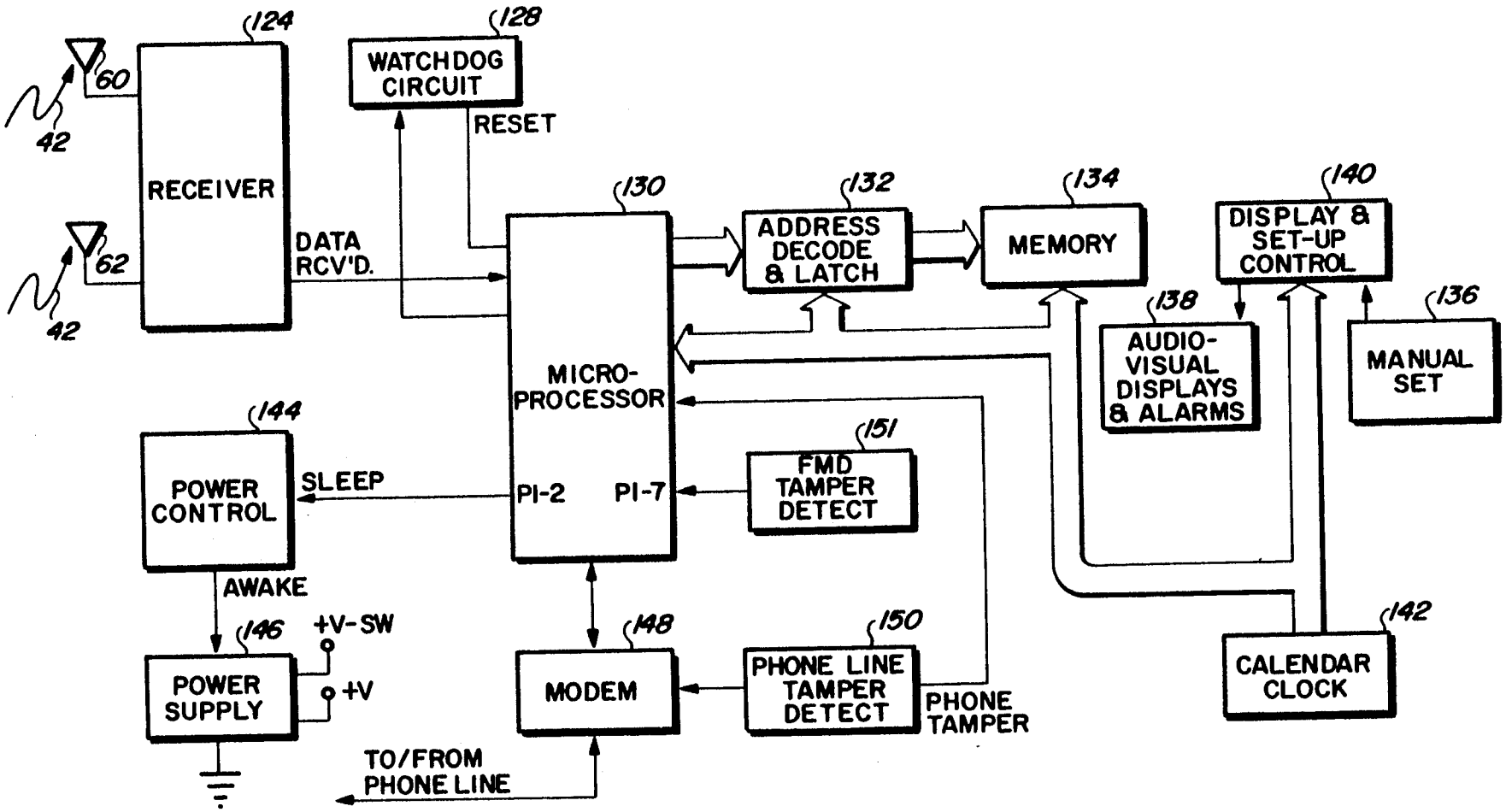
FIG. 11 is a block diagram of the FMD.

A representative block diagram of the FMD 40 is shown in FIG. 11. This block diagram is fully explained in U.S. Pat. No. 4,912,432, incorporated herein by reference, where the same figure appears as FIG. 12. For purposes of the present invention, it suffices to note that the FMD 40 includes a microprocessor 130 to control the operation of the FMD. This microprocessor 130 is coupled to suitable memory circuits 134. These memory circuits include both random access memory (RAM) devices, electronically erasable programmable read only memory (EEPROM) devices, and erasable programmable read only memory devices (EPROM). Typically, an operating program for the microprocessor 130 is stored in the EPROM, and is used to control the operation of the FMD. This operating program includes certain operating parameters, usually stored in EEPROM, but some of which may at least temporarily be stored in RAM, that define how the FMD operates. It is critically important to the integrity of the EHAM system that these operating parameters be protected, and not altered or changed, except by authorized personnel. Accordingly, one of the main purposes of the present invention is to protect these FMD operating parameters as stored in the memory circuits of the FMD so that only authorized personnel have access to evaluate (read) them, and/or to change (write) them as required in order to meet the needs of a particular EHAM application.

Figure 2:
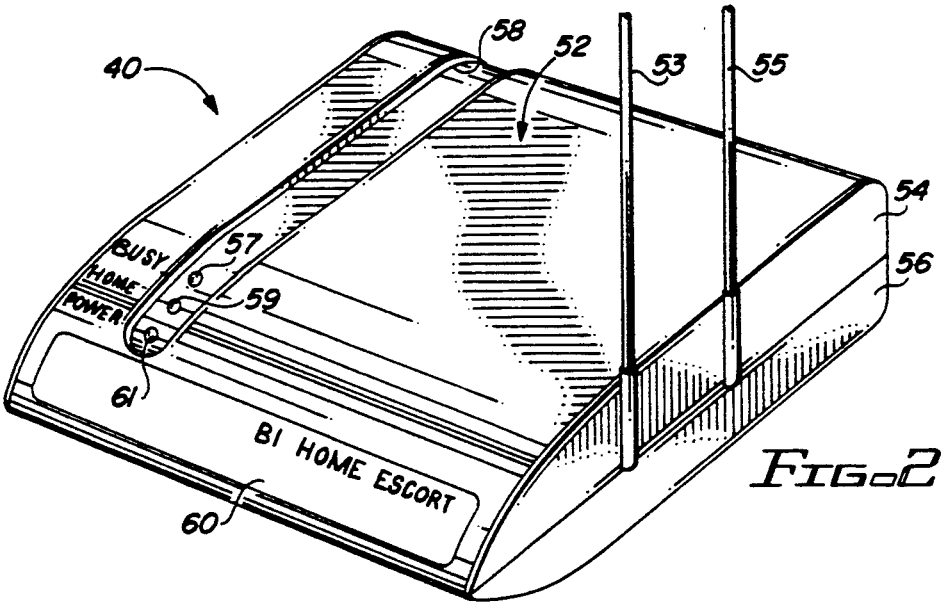
FIG. 2 shows a generally frontal pictorial representation of an FMD, and illustrates the general appearance of the housing of the FMD.
Figure 12:
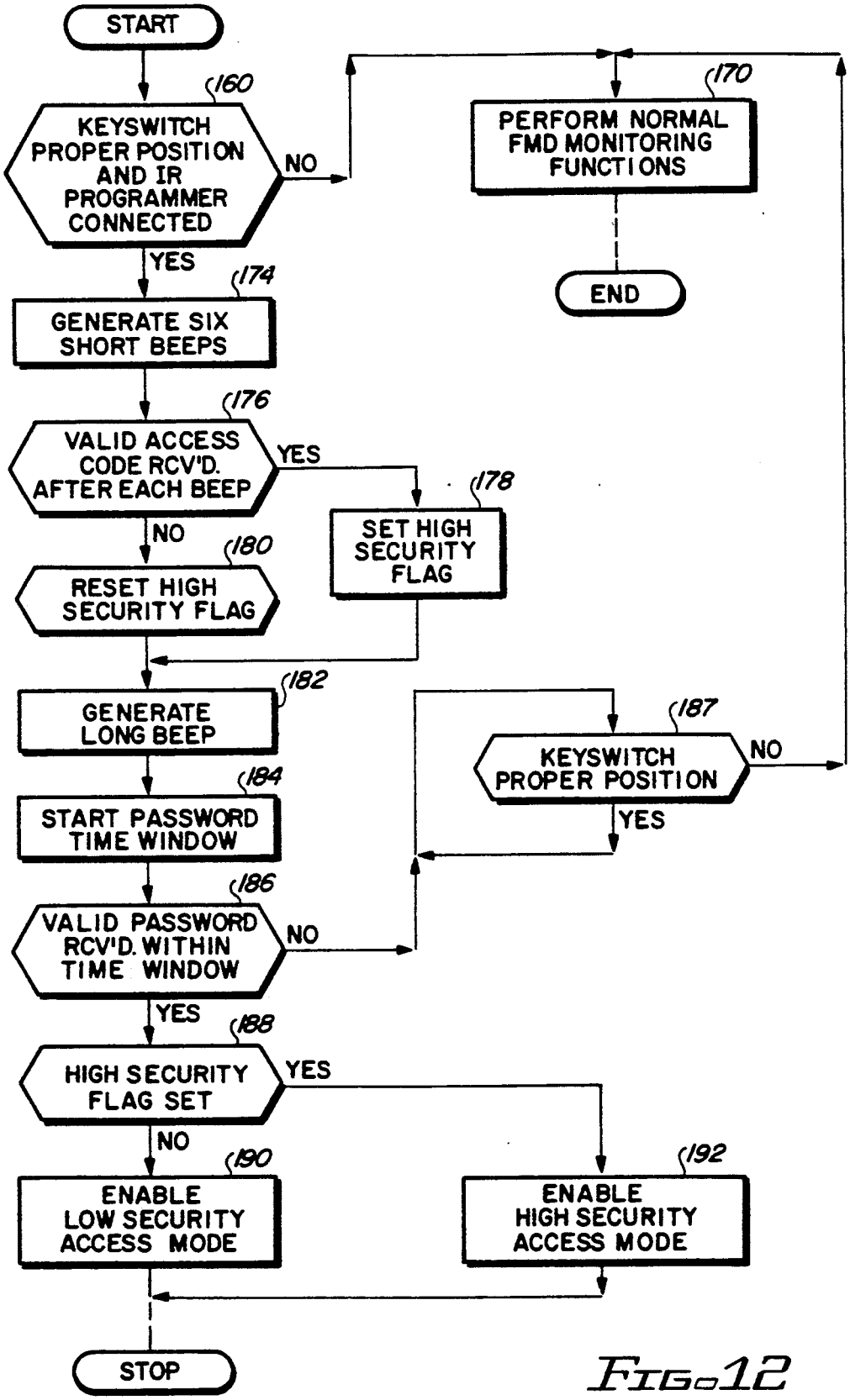
FIG. 12 is a simplified flow chart of the program used within the microprocessor of the FMD to restrict access to authorized personnel.

To this end the present invention includes a plurality of security features that restrict access to the circuits within the FMD. One of the security features used by the present invention is to enclose such circuits within a closed housing 52. FIG. 2 shows a generally frontal pictorial representation of the FMD 40, and illustrates the general appearance of its housing 52. In general, the housing 52 provides an attractive, yet ruggedized, enclosure for the FMD circuits. It includes two spaced-apart antennas, 53 and 55, for receiving the ID signals 42 or 42' from the tags or repeaters. It also includes three status lights that are visible from the front of the device. These include a red "phone busy" indicator light 57 (which is optionally lighted whenever the offender's phone line is busy), a yellow "unit home" light 59 (which is optionally lighted whenever the FMD receives an ID signal), and a green "power" light 61 (which is lighted whenever power is applied to the FMD and the FMD is operating in its normal monitoring mode). For the embodiment shown in FIG. 2, these indicator lights are located in a recess channel 58 that parallels one edge of the housing 52. A name plate 60, or equivalent area or design, e.g., showing the manufacturer's name and model number of the FMD, may also be optionally included on the front of the The housing 52 essentially comprises two halves, an upper half 54 and a lower half 56. During manufacture and assembly of the FMD 40, the two halves 54 and 56 are not joined together, and the electronic circuits and other components of the FMD, as shown in the block diagram of FIG. 12, are fully accessible for purposes of assembly and test. Once the two halves are joined together, as a final step of the assembly of the FMD, they cannot be taken apart without destroying at least a portion of the housing 52. Hence, some measure of physical security for the FMD circuits is provided through the use of the closed housing 52.

Once the housing 52 is closed, it is still necessary to provide some means for accessing the operational parameters stored within the memory circuits of the FMD. This is because each installation of the FMD may require so==customization in order to best suit the needs of the particular location and offender being monitored. Thus, there must be some means for coupling appropriate programming signals into the FMD circuits. Also, there is a need to couple power into the FMD, as well as a need to couple a telecommunicative link, e.g., a telephone line and/or telephone, to the FMD circuits.

Figure 3:
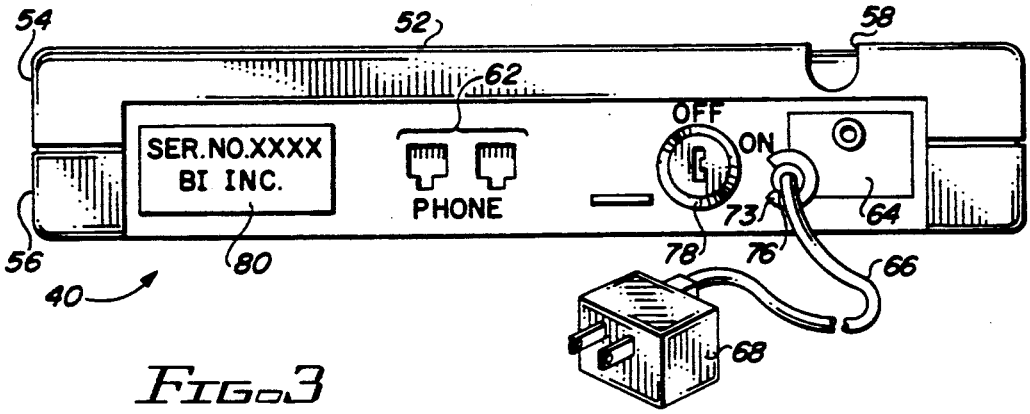
FIG. 3 shows the rear of the FMD housing, and illustrates the preferred placement of the key switch, power cord, power cord strain relief fixture, and RJ-11 jacks.

The physical means for providing the desired electrical or signal access into the FMD circuits after the FMD housing 52 is closed is provided by way of two data communication ports and a power input jack, located on the rear of the lower half 56 of the housing 52, as shown in FIG. 3. A first data communication port 62 allows a conventional RJ-11 telephone jack to be plugged into one of two RJ-11 connectors. Two RJ-11 connectors are provided so that the FMD can be connected to both the standard telephone wall jack and to a standard telephone. An appropriate phone line tamper detect circuit 150 (FIG. 11) is coupled to the connectors 62 to detect any disconnection or tampering with these connectors. Such circuit also provides electrical isolation between these jacks and the other circuits within the FMD.

Figure 4:
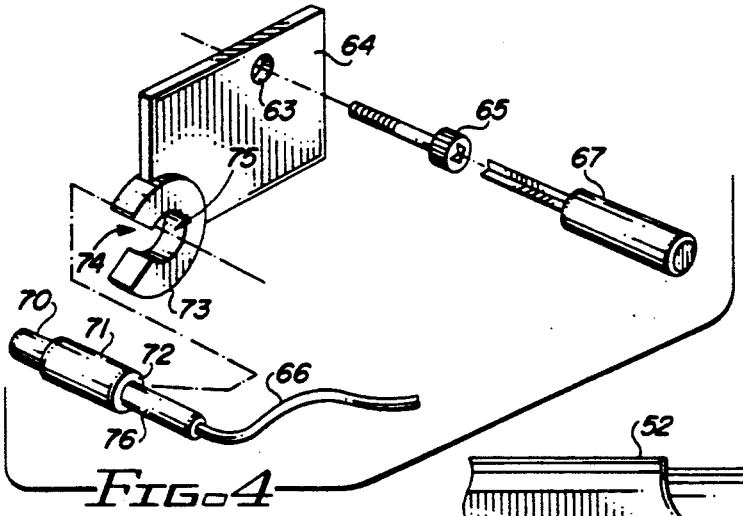
FIG. 4 shows an exploded view of the power cord strain relief fixture, including its attachment means, and the distal end of the power cord.

The other data communication port provided on the FMD housing 52 is not visible in FIG. 3. This is by design. Rather, it is concealed behind a strain relief fixture 64 that is detachably secured to the rear of the housing 52 by means of an attachment screw 65. An exploded view of the strain relief fixture 64, with its attachment screw 65, is shown in FIG. 4. As seen in FIG. 4, the attachment screw 65, in one embodiment, includes a special nonstandard head design that requires the use of a special tool 67 in order to remove it. Thus, only those having the special tool 67 are able to easily remove the screw 65, or equivalent attachment means. The attachment screw 65 fits through a hole 63 in the strain relief fixture 64.

As seen in FIG. 3, a power cord 66 is secured to the FMD 40 by means of the strain relief fixture 64. In the preferred embodiment, a conventional AC adapter 68, designed for direct, insert,ion into a standard AC wall outlet, generates and appropriate AC voltage that is provided by way of the power cord 66 to the circuits internal to the FMD. As seen best in FIG. 4, a distal end of the power cord 66 includes a conventional DC plug tip that extends from an insulated hand grip 71. A smaller insulated support 76 extends rearwardly from the grip 71. A rear shoulder 72 defines the change from the grip 71 to the support 76. This shoulder 72 is adapted to engage the edge of a ring 73 that forms an integral part of the strain gauge relief fixture 64. A hole 75 through the center of the ring 73 is sized to be just slightly larger in diameter than the support 76 of the power cord 66. The ring 73 further includes a slot 74 through which the power cord 66 may readily fit. Thus, once the power cord is placed inside of the ring 73 through the slot 74, the support 76 may be slid into the center 75 of the ring 73 until the shoulder 72 engages the edge of the ring 73. The connector tip 70 is then inserted into the power jack on the rear of the FMD, and the entire strain relief fixture 64 is then secured to the rear of the FMD, thereby firmly seating the power cord connector 70 in its respective jack on the rear of the FMD housing.

Still referring to FIG. 3, a key switch 78 is also included on the rear of the FMD housing 52. This key switch 78 may be of conventional design, and includes two positions, labeled OFF and ON. The key switch 78 can be moved from one position to the other only by inserting a key into the switch and turning the key. Only key switch 78. Thus, only authorized personnel are able to turn the key switch ON or OFF.

Also, a manufacturer's label 80, identifying the serial number and other identifying data with the FMD 40, is typically included on the rear of the FMD housing, as shown in FIG. 3.

Figure 5:
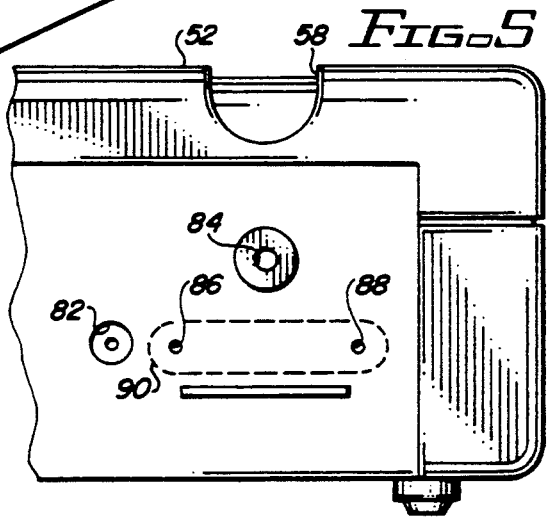
FIG. 5 shows a portion of the rear of the FMD housing with the power cord strain relief fixture removed, revealing the infrared (IR) communications port that includes two holes, one for transmitting IR communication and the other for receiving IR communication signals.

Referring next to FIG. 5, there is shown a portion of the rear of the FMD housing 52 with the power cord strain relief fixture 64 removed. With the strain relief fixture removed, and with the power cord 66 unplugged (as shown in FIG. 5), a power jack 82 is readily visible. The connector tip 70 of the power cord 66 mates with the jack 82. Also visible is a threaded screw hole 84 for receiving the attachment screw 65. In addition, two small holes 86 and 88 are seen. These two holes 86 and 88, and the circuitry behind them (discussed below in connection with FIG. 9), comprise the other data communications port referred to above. This other data communications port is an infrared (IR) communications port 90. Such IR communications port 90 advantageously physically and electrically isolates the circuits within the FMD from anything external to the FMD. Yet, data signals can still be readily sent and received. Hence, the use of a metallic or other electrically conductive connector, through which an offender might introduce a static or other charge into the circuits of the FMD, is avoided.

Data signals are received through one of the holes, e.g., the hole 86, by way of a modulated infrared beam of light that is directed to the hole from a source external to the hole. Similarly, data signals are sent through the other hole, e.g, the hole 88, by sending a modulated IR beam to an IR receiving source external to and aligned with such hole. There are thus no direct electrical connections between the FMD and an external programmer, or equivalent device, that is coupled to the FMD through the IR communications port 90.

Figure 6:
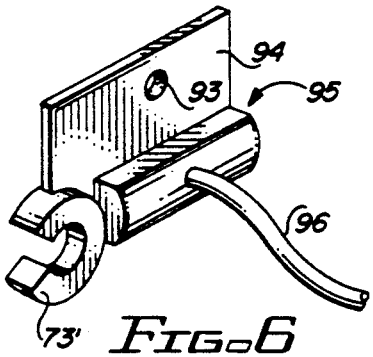
FIG. 6 diagrammatically illustrates an IR coupling head that may be detachably secured to the rear of the FMD in place of the power cord strain relief fixture.
Figure 7:
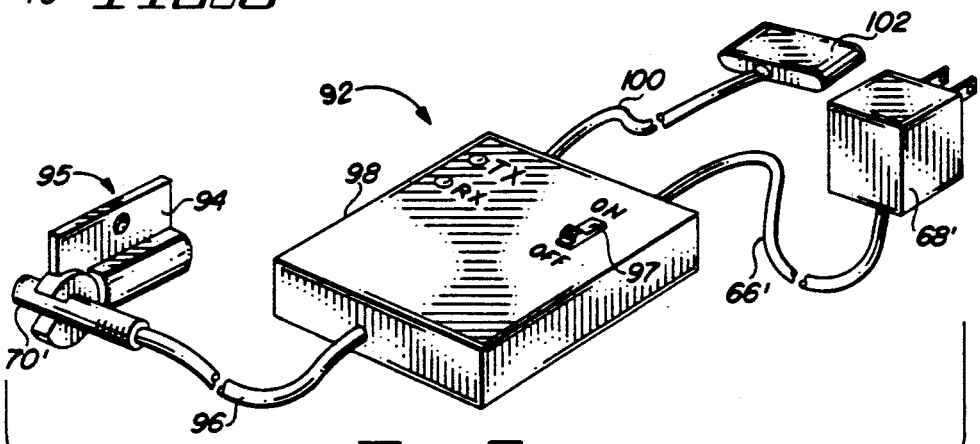
FIG. 7 shows an infrared programming adapter that includes the IR coupling head of FIG. 6, and that is used to couple the IR communications port on the rear of the FMD to an external programming device.

In order to facilitate the sending and receiving of data signals through the IR communications port 90, an IR adapter 92 is used. Such an IR adapter 92 is shown in FIGS. 6 and 7. The IR adapter 92 includes a coupling head 95, an interface box 98, a power supply 68', and a connector 102. The coupling head 95 is connected to the interface box 98 by way of a conventional electrical cable 96. Similarly, the connector 102 is coupled to the interface box 98 by way of an appropriate electrical cable 100. The power supply 68', which may be a conventional AC converter, the same as is used to power the FMD directly, connects to the interface box by way of a power cord 66'. Power from the AC adapter 68' is used to power the circuits in the interface box 98, as well as to power the FMD, as controlled by an on/off switch 97. That is, a portion of the cable 96 includes DC power, controlled by switch 97, that is broken out of the cable 96 at the coupler head 95 and connected to an appropriate power connector 70'. The power connector 70' may be the same as previously described relative to the power connector 70.

The coupling head 95, best seen in FIG. 6, includes a support plate 94 that is approximately the same size as the strain relief fixture 64. Such support plate 94 includes a hole 93 through which the attachment screw 65 may be inserted in order to secure the coupling head to the rear of the FMD. The support plate also includes a ring 73' for seating and securing a power cord to the FMD, the same as has been previously described. Further, the coupling head includes an appropriate IR emitter and detector. Such IR emitter and detector are spatially positioned on the support plate 94 so as to be in alignment with the holes 86 and 88 of the IR communications port 90 when the coupling head is detachably secured to the FMD in place of the strain relief fixture 64.

Figure 8A:
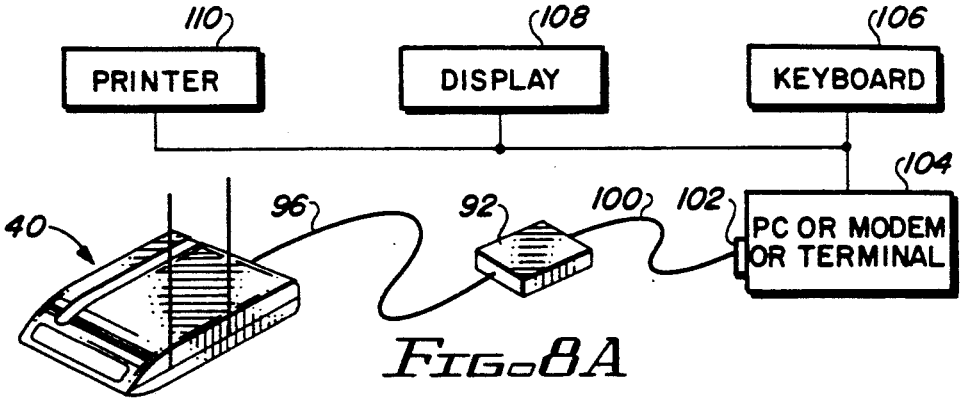
FIG. 8A diagrammatically shows the FMD coupled to an external through the IR adapter of FIG. 7, with the main elements of the external programming device being represented in block diagram form.

Referring next to FIG. 8A, the FMD 40 is shown coupled to an external programming device ("programmer") 104 through the IR adapter 92. The programmer 104 may be realized using any suitable device having means for generating the appropriate data signals, such as a personal computer (PC) or equivalent work station. The programmer 104 includes a keyboard 106, a display 108, and if desired, a printer 110. The operation of the programmer is conventional. That is, data is coupled to and from the programmer 104 through either a serial or parallel port to which the connector 102 of the IR adapter 92 is connected. (In the preferred embodiment, a serial port is used.) In this regard, the entire FMD, as accessed through the IR adapter 92, appears no different to the programmer than does any other peripheral device to which the programmer could be connected, such as printers, modems, and the like. If desired, the IR adapter 92 may couple to a modem, and the programmer 104 may then access the IR adapter and FMD through any standard telecommunicative link accessible through the modem. Thus, it is possible for the programmer to be physically located some distance from the FMD, if needed.

Figure 8B:
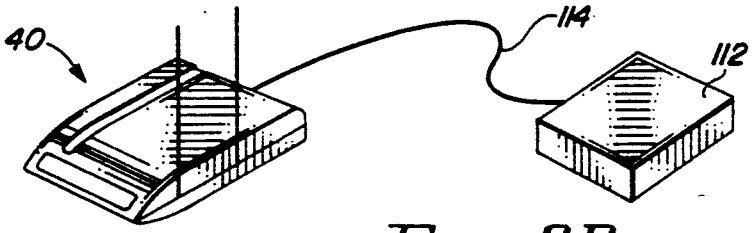
FIG. 8B diagrammatically shows an external peripheral device coupled to the FMD through the IR communications port.

FIG. 8B diagrammatically shows an external peripheral device 112 coupled to the FMD 40 through the IR communications port. A connecting cable 114 between the peripheral device 112 and the FMD 140 may be realized using fiber optics, thereby avoiding the need for the IR adapter 92. Alternatively, the peripheral device 112 may be coupled to the FMD 40 through the IR adapter 92, or equivalent.

The peripheral device 112 may be any desired device that supplements the monitoring operation of the FMD. For example, the device 112 may include means for analyzing the breath of the offender to determine if the offender has been drinking alcohol. Alternatively, the device 112 may measure any desired physiological parameter of the offender, such as heart rate, etc., in an attempt to ascertain whether the offender is under the influence of drugs. Further, the device 112 may include circuits for analyzing the speech of the offender, either for the purpose of identifying the offender or to determine if the offender is under the influence of alcohol or drugs (resulting in slurred speech). Similarly, the device 112 could include means for electronically analyzing the handwriting of the offender, again either for the purpose of identifying the offender or to determine if the offender is under the influence of some type of drug. The device 112 may also include circuitry for electronically sensing the fingerprint of the offender. Any or all of the above types of supplemental monitoring, or similar types of monitoring, may be carried out by the peripheral device 112, which device 112 may be coupled to the FMD through the IR communications port 90.

Figure 9:
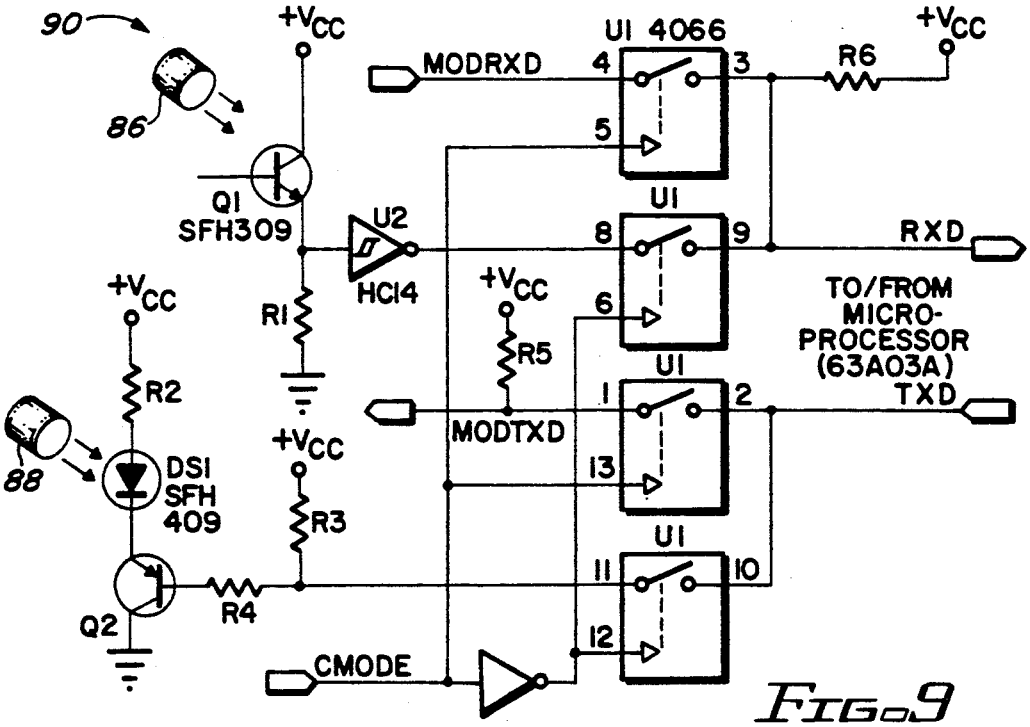
FIG. 9 is a schematic diagram of the IR communications port within the FMD.

Referring next to FIG. 9, a schematic diagram of the IR communications port 90 used within the FMD 40 is shown. The holes 86 and 88 included in the rear of the FMD housing are symbolically depicted in FIG. 9 as cylinders. Infrared light passing through the hole 86 strikes the base of IR sensitive transistor Q1, causing Q1 to conduct. With Q1 conducting, a current flows through resistor R1, connected between the emitter of Q1 and ground, causing the voltage at the emitter of Q1 to rise. This voltage passes through buffer invertor gate U2, and is routed through one of the poles of a multiple-pole solid state switch U1 to a receive terminal line, RXD. The RXD terminal line may then be coupled to the microprocessor 130 within the FMD. Pulsed infrared light that impinges upon the base of Q1 in accordance with an appropriate data modulation pattern thus causes corresponding electrical pulses to appear at the emitter of transistor Q1, which electrical pulses are then transferred to the microprocessor through one of the poles of the switch U1.

In a similar manner, pulses of infrared light, representing desired data that is to be transmitted through the hole 88, are generated by light emitting diode DS1 whenever transistor Q2 is turned on. The diode DS1 is positioned in alignment with the hole 88. Infrared light is generated by the diode whenever current flows therethrough. The anode of the diode is connected to the emitter of PNP transistor Q2, which may be, e.g, a 2N3906 transistor. Transistor Q2 is turned on by applying a low voltage to its base, and is turned off by applying a high voltage to its base. Thus, data to be transmitted is presented to the base of Q2 in an appropriate modulation pattern through resistor R2. This data may be obtained from the transmit terminal line, TXD, obtained from the microprocessor 130 of the FMD through another of the poles of the switch U1.

As seen in FIG. 9, the emitter diode DS1 may be realized using an SFH409 diode, or equivalent diode, available from numerous semiconductor vendors Siemens. Similarly, the infrared detector Q1 may be realized using an SFH309 transistor, or equivalent transistor, also available from the same semiconductor vendors. The multi-pole switch U1 may be realized using a commercially available 4066 quad switch, also available from various semiconductor vendors.

As seen in FIG. 9, the infrared communications port 90 further includes means for directing test data available at a test terminal MODRXD directly to the microprocessor 130 (which microprocessor may be a 63A03A processor manufactured by Hitachi) through the receive data terminal RXD in lieu of the data received through the IR detector Q1. Similarly, test data from the microprocessor may be directed to a test terminal MODTXD rather than to the IR emitter DSI. This option is made available through the use of other poles of the multi-pole switch U1. A control signal, CMODE, controls the operation of the multi-pole switch U1 in conventional manner in order to connect the desired RXD signal source, i.e., the IR detector Q1 or test data, to the microprocessor RXD terminal. Likewise, the control signal, CMODE, also controls switch U1 to connect the desired TXD signal source originating at the microprocessor to either the IR emitter DSI or the test terminal MODTXD.

Manufacturing jumpers, typically coupled to the microprocessor, are strategically placed within the FMD circuits, advantageously allowing access to the desired FMD circuits without having to successfully pass the stringent and time consuming access procedures described below in connection with FIGS. 12 and 13. That is, with the manufacturing configuration jumpers in place, the FMD bypasses the security measures described elsewhere herein. With the FMD configured in this manufacturing mode, the infrared link 90 may be used to communicate with the FMD for the purposes of invoking various manufacturing diagnostic tests and annunciating test results. When factory testing and programming have been completed, and before the FMD housing is closed, the manufacturing jumpers are removed. Once removed, all of the security measures must thereafter be followed in order to transmit data through the IR link 90. The use of such manufacturing jumpers thus facilitates the expeditious manufacture of the FMD in that the time consuming authorization validation techniques are avoided that would normally have to be followed in order to transfer data through the IR communications port.

Figure 10:
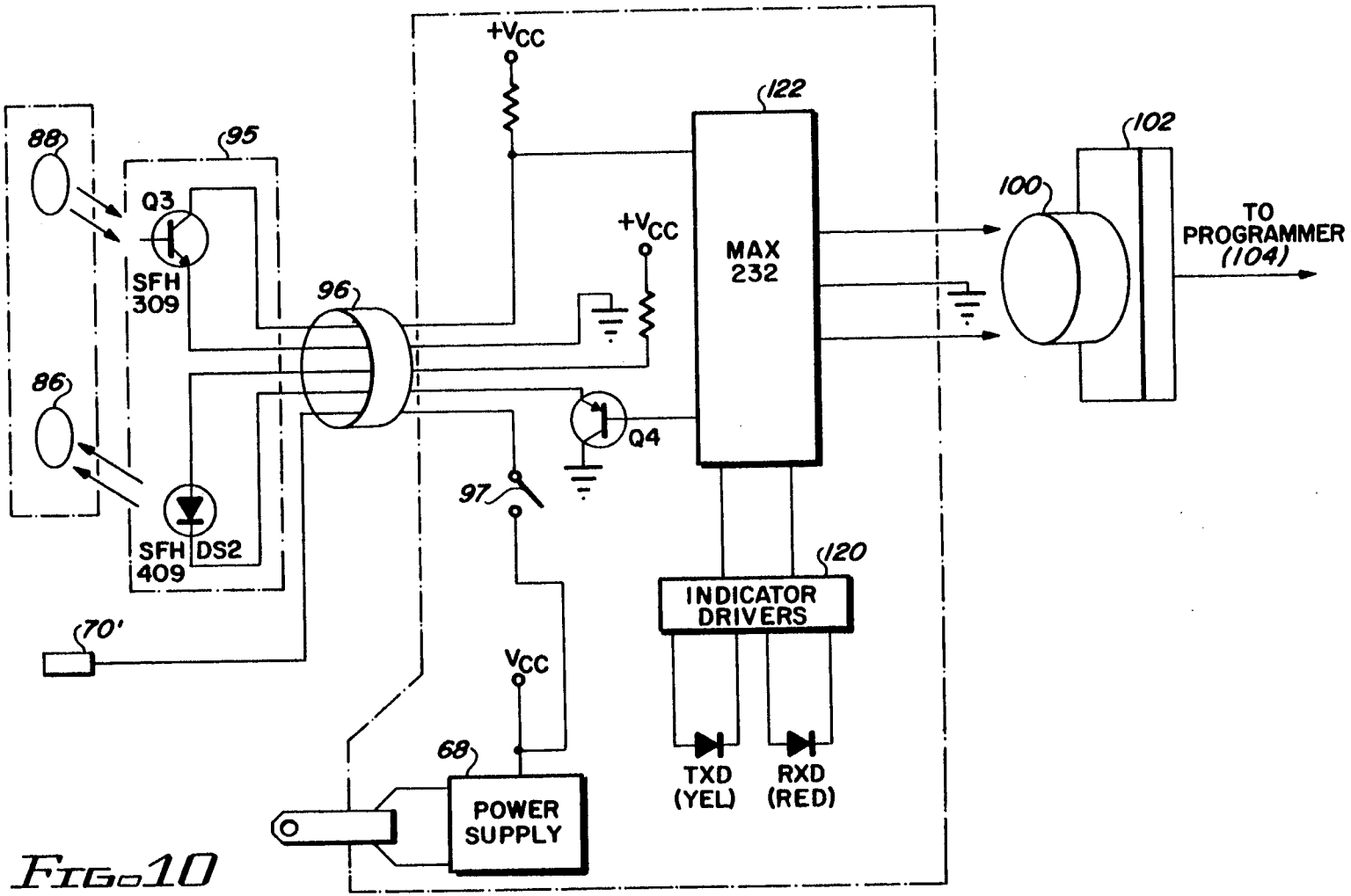
FIG. 10 is a schematic diagram of the IR adapter of FIG. 7.

FIG. 10 shows a schematic diagram of the IR adapter 92 shown pictorially in FIG. 7. The coupling head 95 of the adapter includes an IR detector Q3 and an IR emitter DS2. The IR detector Q3 may be realized using an SFH309 transistor, the same as was used for the IR detector Q1 in the FMD. The IR emitter DS2 may be realized using an SFH409 diode, the same as was used for the IR emitter DS1 in the FMD. The IR detector Q3 is aligned within the coupling head 95 so as to receive any IR signals emitted from the hole 88 by the IR emitter DS1 in the FMD. Similarly, the IR emitter DS2 is aligned within the coupling head 95 so as to transmit any IR signals through the hole 86 to the IR detector Q1 in the FMD. Emitter DS2 is controlled by switching transistor Q4 within the interface box 98. An interface circuit 122, such as the MAX 232 TTL converter available from MAXIM, couples and buffers the signals from the IR detector Q3 and the signals used to control the switching transistor Q4 (which in turn controls the emitter DS2) as such signals pass through the cable 100 as they are sent to or received from the programmer 104. Indicator lights, driven by appropriate indicator driver circuit 120, light up whenever the appropriate data is present. Thus, when data is being transmitted, a yellow indicator light, labeled TXD, is lighted. When data is being received, a red indicator light, labeled RXD, is lighted.

Also shown in FIG. 10 is the switch 97 that controls the delivery of power to the FMD through the power connection jack 70'. The use of such switch facilitates access into the FMD circuits as part of the access procedure explained more fully below, which access procedure requires that power be applied to the FMD in a specificed sequence relative to other events that must also occur.

FIG. 11 is a representative block diagram of the FMD 40. This block diagram, and the basic operation of the FMD, have been described elsewhere. Equivalent FMD configurations may, of course, be used. For purposes of the present invention, any FMD configuration that uses a microprocessor, or equivalent circuit, controlled by operating parameters stored in a memory device, may utilize the present invention.

As described thus far, it is thus seen that several features combine to provide physical security for the FMD, and to prevent unauthorized data entry into the FMD circuits. First, the FMD circuits are housed in a closed housing that cannot be opened. Second, the communications port through which data access to the FMD memory circuits is obtained is physically hidden on the FMD housing. Third, the hidden communications port can only be made visible through the use of a special tool. Fourth, even when the special tool is used, and the communications port is visible, it does not necessarily appear as a communications port. No conventional connectors are used. Rather, because the port utilizes IR signals, which signals pass through air, the port simply comprises two small, spaced-apart holes. Without knowledge of the IR communications port and its function, the presence of the IR communications port may thus not even be recognized.

In addition to the above physical security features, however, an important feature of the present invention is to provide additional restrictions that control access to the operational parameters stored in the FMD. Such additional restrictions are imposed by the main operating program of the microprocessor, coupled with appropriate logic circuitry.

A simplified flow chart of the main steps imposed by the FMD in order to further restrict and control access to its operational parameters is shown in the flow chart of FIG. 12. In FIG. 12, as well as the other flow charts described herein, each main step of the described process is shown as a "box" or "block", with each box or block having a corresponding reference number. Those skilled in the operation and programming of microprocessor-controlled apparatus, given the information presented herein, could readily fashion a program for a microprocessor that would implement the steps shown in FIG. 12.

Referring then to FIG. 12, it is seen that a first step in limiting access to the operational parameters of the FMD is to make a determination as to whether the key switch is in the "proper" or specified position (block 160). Additionally, in some embodiments, a determination may also be made at this time as to whether a programmer, or equivalent device, is coupled to the IR communications port (block 160). If this determination is made, some type of coordination or "handshaking" is required between the programmer or other device, e.g., so that if a certain bit sequence is transmitted by the FMD, a corresponding bit sequence is retransmitted back to the FMD.

If a determination is made (at block 160) that the keyswitch is not in the proper position (and, for some embodiments, that the IR port is not active), then the FMd simply performs its normal operating functions as if nothing unusual had happened (block 170).

If a determination is made (at block 160) that the keyswitch is in the proper position (and, for some embodiments, if the IR port is active, i.e, that a programmer or equivalent external device is coupled to the IR port), then the FMD issues a series of six short beeps (block 174). There is a few seconds delay between each beep. Some of the indicator lights on the front of the FMD may also come on and go off in synchrony with these beeps. For example, at the first beep, the green "power" light 61 (FIG. 2) may come one. At the second beep, the yellow "unit home" light 59 may come on, making a total of two lights that are on. At the third beep, the red "phone busy" light 57 may come one, making a total of three lights that are on. At the fourth beep, the green "power" light 61 may go off, leaving the yellow light 59 and the red light 57 on. At the fifth beep, the yellow light 59 may go off, leaving only the red light 57 on. At the sixth beep, the red light 57 may go off, thereby leaving all of the lights off.

Advantageously, the access method used by the present invention provides different levels of security access to the operating parameters as a function of the operating personnel's security access level. Those having a low security level access (not needing access to all of the operating parameters) are not given the same passwords and operational knowledge concerning accessing the FMD as are those who have a high security access level (needing access to all of the operating parameters). Those who have a high security access level know that after each beep, a prescribed action must be quickly taken prior to the occurrence of the next beep. In general, this prescribed action involves keying in a specified access code at the same time that a designated key is held in the depressed position. If all of the access codes are correctly entered after each beep (block 176), then a high security flag is set (block 180). If not, then the high security flag is reset (block 180). Those having a low security level access have no knowledge concerning the entry of the access codes after each beep, and hence do not even attempt such entry. Thus, for such low security level access personnel, the high security flag is always reset.

Regardless of whether the high security flag is set or reset, the FMD next generates a long beep (block 182). At the conclusion of this long beep, a time window or time interval begins (block 184) during which the person attempting access must enter a valid password. A password comprises a particular sequence of alphanumeric characters, such as "ABCDEFGHI". Typically, this time window is on the order of 5–10 seconds, preferrably 5 seconds. If a valid password is not entered during the time window (block 186), then nothing happens, unless the keyswitch is switched from its proper position (block 187), and the access sequence must be initiated again (i.e., power must be removed from the FMD, the key switch must be turned to its proper position, power reapplied, etc.). If the keyswitch is switched from its proper position (block 187), then the FMD performs its normal monitoring function. If however, a valid password is entered during the time window (block 184), then a determination is next made as to whether the high security flag is set (block 190). If so, a high security access mode is enabled where full access is granted to the entire set of operating parameters (block 192). If not, a low security access mode is enabled where only partial access is granted to some of the operating parameters (block 190).

Table 1 below lists various operating parameters that are typically programmed into an FMD and the level of security that allows access to each one. As seen in Table 1, a high security access level allows all of the operating parameters to be accessed and modified. A low security access level, on the other hand, allows only a subset of the operating parameters to be accessed. Low level security access is usually granted to those who install the FMD, and monitor its use while in the field. High level security access, on the other hand, is granted only to those who need such access, as manufacturing engineers, troubleshooters, or others who have to keep the EHAM system operational.

TABLE 1

FMD Operating Parameters and Access Levels

| Parameter | High Security | Low Security |
|---|---|---|
| Unit Number | X | |
| Transmitter code | X | |
| Date of Manufacture | X | |
| Serial Number | X | |
| Phone Number | X | X |
| Tone or Pulse Dial | X | X |
| Unit Home LED Enable | X | X |
| Hours to first test report | X | X |
| Hours between test reports | X | X |
| Customer Programmable | X | |
| Customer Password | X | X |
| Manufacturer Password | X | |
| Transmitter Range | X | X |
| Leave Window | X | X |

The method used to gain low level access security so as to be able to monitor and/or reprogram those parameters identified in Table 1 as "low security" may be summarized as follows:

(1) Remove power from the FMD. (2) Turn the key switch to the "proper" position.
(3) Connect the IR adapter and programmer.
(4) Apply power to the IR adapter and programmer.
(5) Apply power to the FMD.
(6) Allow the six short beeps and one long beep to occur.
(7) Within five seconds of the end of the long beep, enter the assigned password. allotted time window, access is then granted to modify the operational parameters marked as "Low Security" in Table 1.

By way of example, and with reference to FIGS. A, 13B and 13C, the method used by authorized personnel to gain high level access security to the FMD will next be described. This is the same method used during the manufacture of the FMD in order to customize the FMD for a particular monitoring application. In the discussion that follows, it is assumed that the FMD case is closed. It is also assumed that the external programmer can send and receive data through an appropriate communications port in full duplex, 8 bit, no parity, at 1200 baud. It is further assumed that two RS232 ports are available on the programmer, and that the programmer is set to an Upper Case mode. A serial printer is connected to one of the RS232 ports. The IR adapter is connected to the other RS232 port. A representative terminal that could be used as the programmer is a WYSE 30, available from WYSE Technology.

Figure 13A:
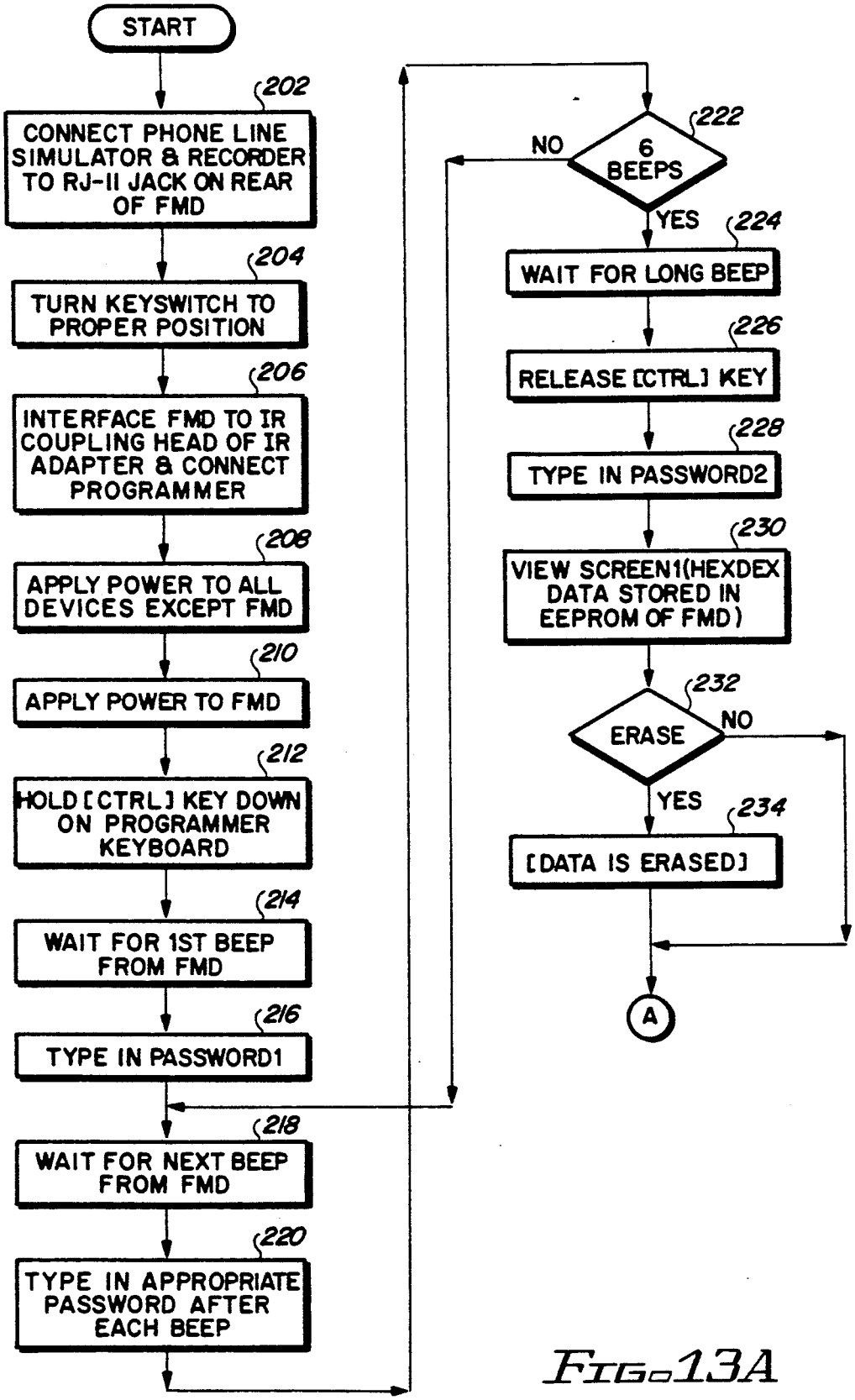
FIGS. 13A, 13B, and 13C are a flow chart showing the method used by authorized personnel to gain high level access to the FMD.

As an optional preliminary step, a phone line simulator and recorder are connected to the RJ-11 connectors on the rear of the FMD (block 202, FIG. 13A). The key switch is then turned to the "proper" position (block 204). Next, the FMD is interfaced with the IR adapter through the IR communications port on the rear of the FMD as previously described. One of the RS232 ports of the external programmer is then connected to the other side of the IR adapter, thereby coupling the external programmer to the FMD through its IR communications port (block 206). Power is next applied to all of the devices except the FMD (block 208). Then, power is applied to the FMD (block 210).

As indicated above, once power is applied to the FMD with the key switch in its "proper" position, a series of short beeps will soon be generated. Prior to the first beep, the [CTRL]key on the terminal keyboard (of the programmer) is held down, and must continue to be held down throughout all of the six beeps (block 212). As each beep is heard, a prescribed access code, or password, must be entered (blocks 214–222). A typical access code or password for this purpose may be "BIACKZ". The beeps should not be anticipated. If a key is depressed before the appropriate beep, the entire process must be started over.

After entering the appropriate access codes after each of the six beeps, a long beep will sound (block 224). At the conclusion of the long beep, the [CTRL] key may be released (block 226). Further, at the end of the long beep, a five-second window exists during which a second password, of the form "ZYXWVUTSR", must be entered (block 228). If the second password is not entered correctly within the five second time window, AC power must be removed and the cycle started over.

If the access codes and passwords are successfully entered, the data stored in the EEPROM of the FMD is displayed on the terminal screen of the programmer (block 230) as a first screen, SCREEN1. A representation the type of information included in the SCREEN1 display is shown below in Table 2.

TABLE 2

BI P/N: 9-70-13007-00 Rev. A
Firmware ID: BIC4000AM, Version 1.00.03, Jun 26 1990, 13:42:01
Copyright (C) 1990 by BI Incorporated. All Rights reserved.

| | | | | | | | | | |
|---|---|---|---|---|---|---|---|---|---|
| 0000: | 0000 | 10E1 | 9914 | 2F5B | B186 | 0008 | 0004 | 0801 | .../C... |
| 0008: | 0C40 | 8731 | AD98 | 312C | 3535 | 3535 | 3535 | 3500 | .@.1..1.5555555. |
| 0010: | 0000 | 0000 | 0000 | 0000 | 0000 | FFFF | FFFF | FFFF | ... |
| 0018: | FFFF | FFFF | FFFF | FFFF | FFFF | FFFF | FFFF | FFFF | ... |
| 0020: | FFFF | FFFF | FFFF | FFFF | FFFF | FFFF | FFFF | FFFF | ... |
| 0028: | FFFF | FFFF | FFFF | FFFF | FFFF | FFFF | FFFF | FFFF | ... |
| 0030: | FFFF | FFFF | FFFF | FFFF | FFFF | FFFF | FFFF | FFFF | ... |
| 0038: | FFFF | FFFF | FFFF | FFFF | FFFF | FFFF | FFFF | 2DE1 | ... |

Erase? [No]

Note that the data displayed in SCREEN1 is in hexadecimal form. Note also that included in the title is the part number and revision level of the FMD firmware, as well as product identification information (the example shown in Table 2 identifies the product as BIC40-00AM).

Once the information stored in the EEPROM is displayed, the operator can select whether or not this information should be erased (block 232). Typically, it is not necessary to erase the EEPROM, so depressing the [RETURN] key enters the default NO. If the erase option is selected, then the EEPROM is erased (block 234).

Figure 13B:
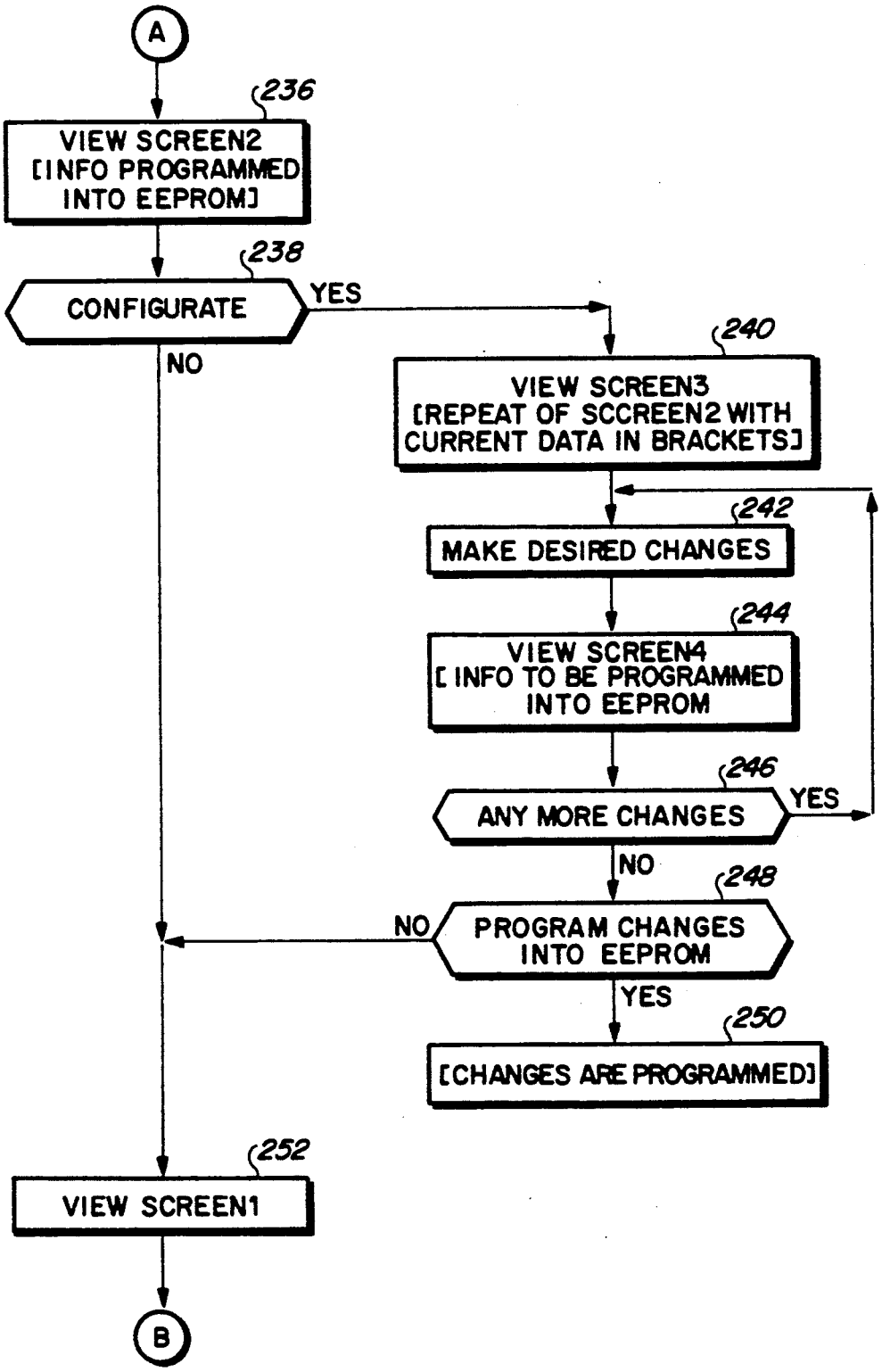
Figure 13C:
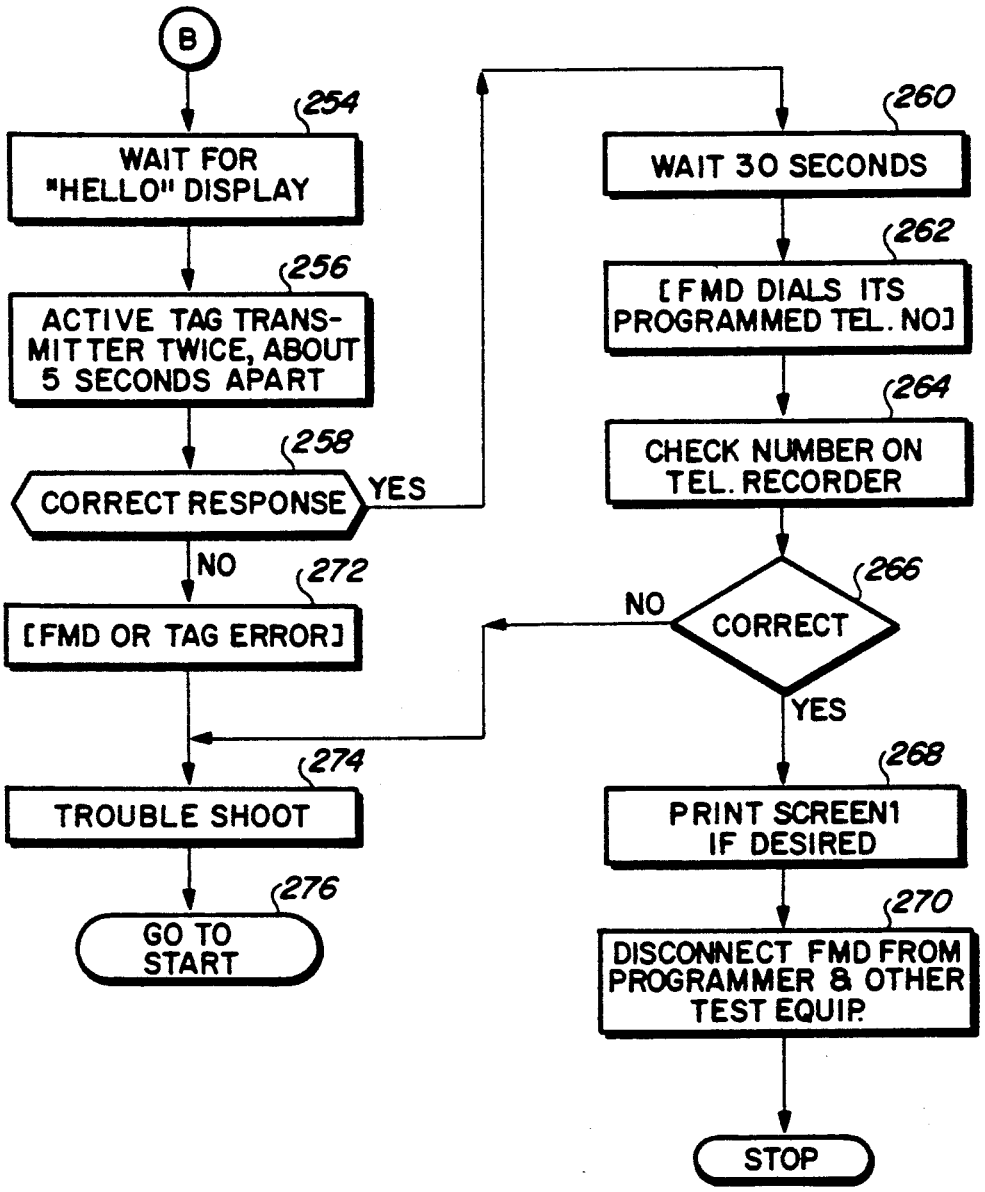

After SCREEN1 is viewed, and a decision is made as to whether the EEPROM data is to be erased, a second screen of information, SCREEN2, is displayed (block 236, FIG. 13B). A representation of the type of information included in the SCREEN2 display is shown in Table 3.

TABLE 3

| | |
|---|---|
| UNIT NUMBER: | 4321 |
| XMTR CODE: | 8 (08 hex) |
| PHONE NUMBER: | 1,5555555 |
| HOME LED ENABLE: | No |
| HRS TO 1ST AUTO TEST REPORT: | 4 |
| HRS BETWEEN AUTO TEST REPORTS: | 8 |
| CUSTOMER PROGRAMMABLE | Yes |
| CUSTOMER PASSWORD: | ABCDEFGHI |
| BI PASSWORD: | ZYXWVUTSR |
| Any Changes? | |

The SCREEN2 information displays the information currently programmed in the EEPROM in a more easily understand format (not hexadecimal). After displaying SCREEN2, the operator can select whether or not this information is to be configured (block 238), i.e., reprogrammed, by entering "Y", [RETURN]. If the operator selects the CONFIGURE option, another screen, SCREEN3, is displayed (block 240). SCREEN3 repeats the same information contained in SCREEN2, but with the current EEPROM data in brackets. The information in brackets thus represents default data, and depressing the [RETURN] key does not change the data. If it is desired to change the data, the new data is entered and the [RETURN] key is depressed (block 242). In this way, some or all of the information shown in SCREEN3 may be modified.

After the information in SCREEN3 has been selectively modified, a new screen results, SCREEN4 (block 244). Table 4 shows a representation of the information contained in SCREEN3 when it is first displayed, and Table 5 shows a representation of SCREEN4, i.e., the information of SCREEN3 after it has been selectively modified.

TABLE 4

| | |
|---|---|
| UNIT NUMBER: | [4321] 1234 |
| XMTR CODE: | [8] 6 |
| PHONE NUMBER: | [1,5555555] 1,8005555555 |
| HOME LED ENABLE: | [No] |
| HRS TO 1ST AUTO TEST REPORT: | [4] |
| HRS BETWEEN AUTO TEST REPORTS | [8] |
| CUSTOMER PROGRMMABLE: | [Yes] |
| CUSTOMER PASSWORD: | ABCDEFGHI |
| BI PASSWORD: | ZYXWVUTSR |
| Any Changes? | |

TABLE 5

| | |
|---|---|
| UNIT NUMBER: | 1234 |

TABLE 5-continued

| | |
|---|---|
| XMTR CODE: | 6 (06 hex) |
| PHONE NUMBER: | 1,8005555555 |
| HOME LED ENABLE: | No |
| HRS TO 1ST AUTO TEST REPORT: | 4 |
| HRS BETWEEN AUTO TEST REPORTS: | 8 |
| CUSTOMER PROGRAMMABLE: | Yes |
| CUSTOMER PASSWORD: | ABCDEFGHI |
| BI PASSWORD: | ZYXWVUTSR |
| Any Changes? | |

After displaying SCREEN4, the operator is asked whether there are any more changes (block 246). If so, such changes are made as described above (blocks 242, If no additional changes are made, the operator is asked whether the changes shown on SCREEN4 are to be programmed into the EEPROM (block 248). If the operator indicates yes ("Y"), the changes are made in (written to) the EEPROM (block 250). If the operator indicates no ("N"), then the changes shown on the screen, SCREEN4, are not made in the EEPROM. In either event, after this selection and resulting action (blocks 248, 250), SCREEN1 is again displayed (block 252), a representation of which screen was shown above in Table 1. Basically, this display is the hexadecimal data as stored in the EEPROM at that time (after the modifications).

Immediately following the display of SCREEN1 the second time, a "HELLO" message appears (block 254). The operator should then activate the matching transmitter tag 44 (FIG. 1) associated with the FMD two times, about five seconds apart (block 256). Each activation should produce either a tampered or untampered beep, depending on the status of the transmitter at the time it is activated. If a correct response is received (block 258), then the FMD dials its internally programmed telephone number (block 262) after about a 30 second delay (block 260). This number is printed out on the Phone Line Recorder. The operator checks this number to make sure it matches the desired number (blocks 264, 266). If it does, the operator may print the last displayed screen to the printer, if desired (block 268). Then, access to the FMD operating parameters is complete and the external programmer and other equipment may be removed from the FMD (block 270). If at any time the correct response is not received, then appropriate troubleshooting must be undertaken to determine and correct the error (blocks 272, 274), and the access must be attempted again (block 276).

As evident from the preceding description, the present invention thus provides an FMD for use in an EHAM system that is "secure", i.e., an FMD that is substantially tamper proof, and that is immune to attempts to thwart its proper operation.

More particularly, as seen from the above description, the FMD provided by the invention utilizes a more secure method of accessing and programming the FMD. This is accomplished through the use of a non-standard communication link between the FMD and an external programmer. Advantageously, this link does not have any exposed connectors or other visible communication ports through which an offender might be tempted to interfere or tamper with the operation of the FMD.

As also seen from the above description, the secure FMD provided by the invention includes different levels of access to the FMD's operational parameters. Programmable access to a full set of the programmable FMD operational parameters is granted only to those having a full knowledge of all of the prescribed conditions and multiple passwords, and the timing associated with when such passwords must be entered. Programmable access to a subset of the full set of operational parameters is granted to those having some knowledge, but not a complete knowledge, about the prescribed conditions and password, such as a field representative or installer. In this manner, the operational parameters are safeguarded by restricting their availability on a "need to know" or "need to access" basis.

As further seen from the preceding description, an FMD made in accordance with the present invention does not exhibit any behavior other than what would be considered normal operation when there is a failed attempt to gain access. Thus, unauthorized individuals (who have no knowledge of the access mechanisms) are not "clued in" to the fact that any such access means exists.

Additionally, as seen from the above, the present invention advantageously provides a secure FMD for use with an EHAM system wherein the factory testing and programming of the FMD is not encumbered or slowed down by the time-consuming access restrictions that are used to safeguard the operating parameters programmed within the FMD.

Moreover, as also seen from the above, the FMD of the present invention also provides a secure nonstandard communication interface with optional peripheral detecting and monitoring devices, external to the FMD, that may be desirable to use for some EHAM applications. Such optional peripheral devices may include, for example, voice verification circuits, alcohol detection devices, signature analysis apparatus, and the like.

While the invention herein disclosed has been described by means of specific embodiments and applications thereof, numerous modifications and variations could be made thereto by those skilled in the art without departing from the scope of the invention set forth in the claims.

What is claimed is:

1. Monitoring apparatus usable with an electronic house arrest monitoring (EHAM) system for monitoring the presence or absence of a specified individual at an assigned location remote from a central monitoring location, said monitoring apparatus comprising:

a closed housing;

detection means within said housing for detecting the presence or absence of the specified individual at the assigned location;

control means within said housing for controlling the operation of said monitoring apparatus in accordance with a set of preprogrammed operating parameters;

electrically erasable programmable read only memory (EEPROM) means within said housing for storing said operating parameters;

random access memory means within said housing for storing data processed by said processing means;

first port means for allowing data access into and out of said RAM means through said control means from a location external to said housing, whereby data may be selectively transferred between said random access memory means and an external device;

second port means coupled to said control means for selectively allowing data to be programmed into said EEPROM means from an external programming device, and for selectively allowing data stored in said EEPROM means to be read by said external programming device, said second port means being concealed on said housing; and access means for allowing access to said EEPROM means through said second port means only when a plurality of prescribed conditions have been met;

whereby said operating parameters for said control means can be accessed only by personnel having knowledge of the location of said second port means and said plurality of prescribed conditions.

2. The monitoring apparatus as set forth in claim 1 wherein said second port means includes a first hole through said housing spaced apart from a second hole through said housing, said first and second holes being concealed behind a removable cover plate, said first hole having receiving means therein for receiving a radiated signal from a source external to said housing, and said second hole having transmitting means therein for transmitting a radiated signal through said second hole to a location external to said housing.

3. The monitoring apparatus as set forth in claim 2 wherein said removable cover plate comprises part of a strain relief fixture that is detachably secured to said housing in order to secure a power cord to the housing of said monitoring apparatus.

4. The monitoring apparatus as set forth in claim 3 wherein said removable cover plate includes attachment means for securing said cover plate to said housing, said attachment means being accessible only with a special tool, whereby only personnel having said special tool may remove said cover plate.

5. The monitoring apparatus as set forth in claim 3 wherein said receiving means comprises an infrared detector that detects an infrared signal that impinges upon said infrared detector, and said transmitting means comprises an infrared emitter that emits an infrared signal through said second hole.

6. The monitoring apparatus as set forth in claim 5 further including an external programming device, said external programming device including a coupling head adapted to transmit and receive infrared signals to and from said first and second holes, respectively, of said second port means.

7. The monitoring apparatus as set forth in claim 6 wherein said coupling head of said external programming device includes a second infrared emitter and a second infrared detector, said second infrared emitter and detector being positioned on a coupling plate so as to be in respective alignment with said first and second holes on said housing when said coupling plate is detachably secured to said housing at the location of said removable cover plate.

8. The monitoring apparatus as set forth in claim 7 wherein said coupling head further includes means for detachably securing said power cord to said housing as said coupling head is detachably secured to said housing.

9. The monitoring apparatus as set forth in claim 6 further including a key switch operable using a key, said key switch assuming either an OFF or an ON position, said monitoring apparatus being operable for performing its monitoring function only when said key switch is in the ON position.

10. The monitoring apparatus as set forth in claim 9 wherein said plurality of prescribed conditions include said key switch being in said specified position prior to applying power to said monitoring apparatus.

11. The monitoring apparatus as set forth in claim 10 wherein said external programming device includes a keyboard coupled thereto, and wherein said plurality of prescribed conditions further includes entering a first password through said keyboard during a predefined time period after power has been applied to said monitoring apparatus.

12. The monitoring apparatus as set forth in claim 11 wherein said control means includes means for generating an audible beep for a prescribed number of times, each having a prescribed duration, after power is applied to said monitoring apparatus if said key switch was in said specified position prior to applying power to said monitoring apparatus, said predefined time period being initiated after said audible beeps have been generated said prescribed number of times.

13. The monitoring apparatus as set forth in claim 12 wherein said control means further includes means for receiving a second password entered through said keyboard during the time interval between the audible beeps generated by said control means, and means responsive to the correct entry of said second passwords for enabling a high security mode if said first password is thereafter entered within said predefined time period.

14. The monitoring apparatus as set forth in claim 13 wherein said second password requires the simultaneous depressing of multiple keys on said keyboard in order to be recognized by said control means as a correct entry.

15. The monitoring apparatus as set forth in claim 5 further including peripheral detection means coupled to the control means of said monitoring apparatus through said second port means, said peripheral detection means including a coupling head adapted to transmit and receive infrared signals to and from said first and second holes, respectively, of said second port means.

16. The monitoring apparatus as set forth in claim 15 wherein said peripheral detection means includes means for detecting alcohol in the breath of said specified individual.

17. The monitoring apparatus as set forth in claim 15 wherein said peripheral detection means includes means for analyzing the voice of said specified individual.

18. A method of restricting access to the operating parameters of a field monitoring device (FMD) used with an electronic house arrest monitoring (EHAM) system, said FMD including a microprocessor for controlling the operation of said FMD as controlled by said operating parameters, said FMD further including an electrically erasable programmable read only memory (EEPROM) device wherein said operating parameters are stored, said method comprsiing the steps of:

(a) concealing a data communications port on a housing of said FMD, said concealed data communications port being visible only upon the removal of a protective plate, said protective plate being removable only through the use of a specially configured tool;

(b) removing said protective plate using said specially configured tool;

(c) detachably securing to said data communications port a coupling head attached to an external programming device, said coupling head requiring the use of said specially configured tool in order to be secured to said data communications port, said external programming device having keyboard means for manually keying in data into said FMD through said data communications ports, and display means for displaying data stored in said EEPROM device;

(d) inhibiting data access through said data communications port until a plurality of prescribed conditions have been established;

whereby only personnel having knowledge of the existence and location of said data communications port, and having said specially configured tool and said external programming device, and further having knowledge of said pluraltiy of prescribed conditions, are able to have access to the operating parameters store din said EEPROM device for the purpose of examining or reprogramming said operating parameters.

19. The emthod of restricting access as set forth in claim 18 wherein said FMD includes a key switch operable only with a specified key, and wherein said plurality of prescribed conditions includes turning said key switch to a "proper" position prior to applying power to said FMD.

20. The method of restricting access as set forth in claim 19 wherein said plurality of prescribed conditions further includes entering a specified password through said external programming device during a specified time interval after power is first applied to said FMD.

* * * * *

UNITED STATES PATENT AND TRADEMARK OFFICE

CERTIFICATE OF CORRECTION

PATENT NO. : 5,146,207

DATED : September 8, 1992

INVENTOR(S) : Henry, et al.

It is certified that error appears in the above-identified patent and that said Letters Patent is hereby corrected as shown below:

Column 10, line 17, after the second occurrence of "the" add --housing 52.--. Column 10, line 34, replace "so==" with --some--. Column 11, line 7, replace "insert,ion" with --insertion--. Column 11, line 36, after "Only", add --authorized personnel are given a key that operates the--. Column 13, lines 66-67, after "vendors", add --, such as--. Column 17, line 53, change "FIGS. A" to --FIGS. 13A--.

IN THE CLAIMS: In Claim 9, column 22, line 63, replace "0N" with --ON--. In Claim 18, column 24, line 34, replace "store din" with --stored in--. In Claim 19, column 24, line 37, replace "emthod" with --method--.

Signed and Sealed this

Fifth Day of October, 1993

*Attest:*

*Attesting Officer*

BRUCE LEHMAN

*Commissioner of Patents and Trademarks*